United States Patent [19]

Cole

[11] 4,015,669

[45] Apr. 5, 1977

[54] CIRCLE MOUNTING BAR AND CIRCLE ASSEMBLY FOR A MOTOR GRADER

[75] Inventor: Carroll Richard Cole, Decatur, Ill.

[73] Assignee: Caterpillar Tractor Co., Peoria, Ill.

[22] Filed: Mar. 3, 1976

[21] Appl. No.: 663,594

[52] U.S. Cl. ..... 172/796; 74/606 R

[51] Int. Cl.[2] ..... E02F 3/76

[58] Field of Search ..... 172/792, 796, 781; 74/606, 413, 467, 69; 212/70; 184/6.12

[56] References Cited

UNITED STATES PATENTS

| | | | |
|---|---|---|---|
| 2,799,099 | 7/1957 | Leliter | 172/667 |
| 3,470,967 | 10/1969 | Page | 172/793 |
| 3,568,778 | 3/1971 | Swisher | 172/792 |
| 3,593,806 | 7/1971 | Gurries | 172/741 |
| 3,712,384 | 1/1973 | Fisher | 172/796 |

*Primary Examiner*—Richard J. Johnson

*Attorney, Agent, or Firm*—Wegner, Stellman, McCord, Wiles & Wood

[57] ABSTRACT

An improved circle mounting bar and circle assembly for a motor grader includes a beam with a connecting end, and integral with the other end of the beam is a circle carrying structure in which an annular upright wall with an outwardly extending integral top flange and a removable bottom flange forms an outwardly open annular cavity. The circle structure is rotatably mounted between the flanges and cooperates with the wall and flanges to form a closed annular chamber which is sealed by circumferential seals, and an internal ring gear is on the circle structure in the cavity. An opening in the upright wall toward the beam accommodates an input drive element that engages the ring gear, and in that area the upright wall is the outer wall of a sealed housing that houses the input element and also contains lubricant for said element and the ring gear.

28 Claims, 4 Drawing Figures

Fig. 1
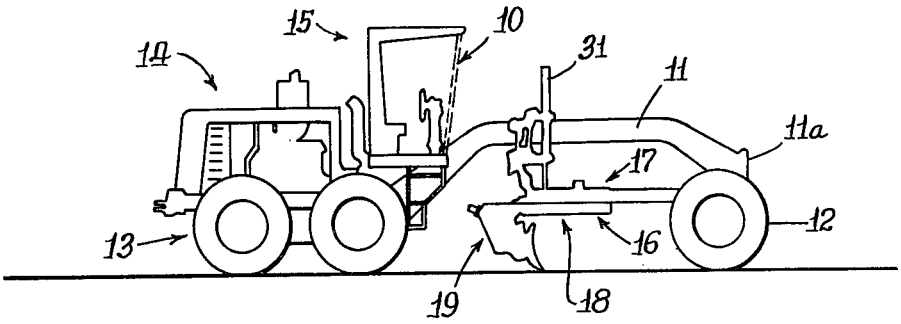
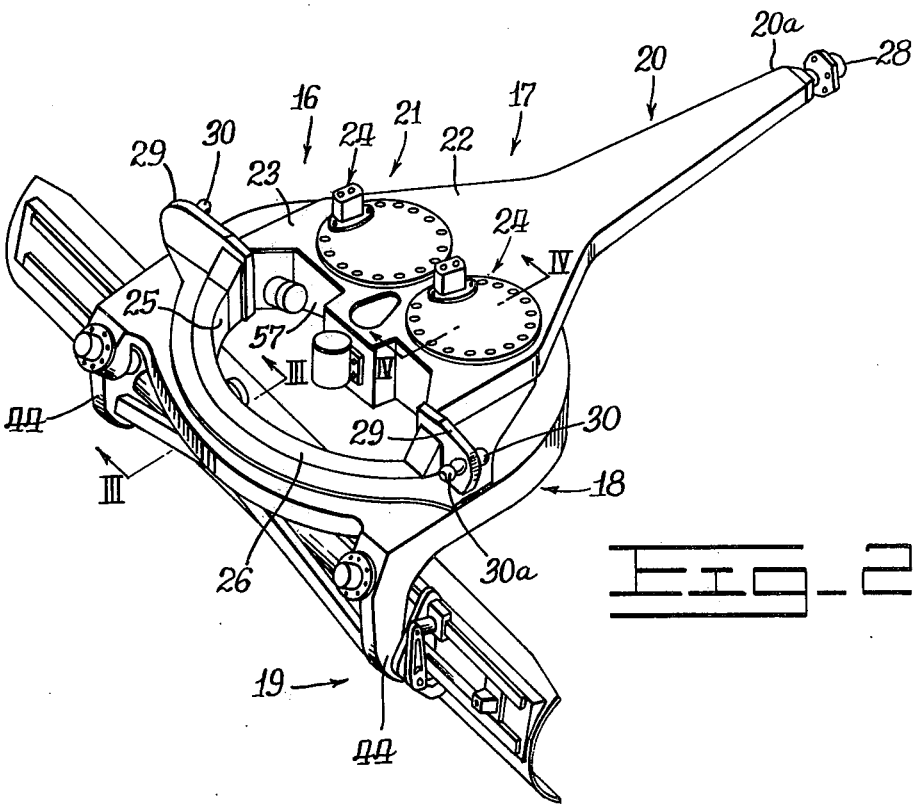
Fig. 2

CIRCLE MOUNTING BAR AND CIRCLE ASSEMBLY FOR A MOTOR GRADER

CROSS-REFERENCE TO RELATED APPLICATION

The draw bar structure, which is shown and described generally in this application, is described in detail and claimed in applicant's copending U.S. Pat. application No. 661,880, filed Feb. 27, 1976.

BACKGROUND OF THE INVENTION

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The circle is mounted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade.

Different types of circle draw bar and circle assemblies are illustrated in U.S. Pat. Nos. 2,799,099, 3,470,967, and 3,593,806.

Typical prior art circle mountings have a circle which carries either an external or an internal ring gear, and the circle is supported upon shoes with lubricant between the shoes and the circle. The entire assembly is exposed to the large amounts of dust and dirt which are generated in a grading operation, and the result is that dirt gets into the lubricant, forming an abrasive compound which causes a very rapid shoe and circle wear, and also produces wear on the circle teeth which must also be lubricated on account of their engagement with a drive element which commonly is a spur gear.

Circle wear is not uniform, nor is wear of the different shoes; and this requires frequent shoe adjustment or replacement, and even this is insufficient to maintain a satisfactorily operating unit because there is no way to adequately compensate for uneven circle wear.

Furthermore, initial adjustment of the circle shoes during construction of a motor grader is a difficult and time consuming operation in order to have the circle properly positioned in the first instance, and have proper engagement between the rear gear and the spur input gear.

SUMMARY OF THE INVENTION

The present invention provides a circle mounting and circle structure which permits an internal ring gear on the circle to be completely housed in a sealed annular chamber which completely protects the ring gear against damaging dust and dirt; and in addition, a sealed mounting between the circle and the circle carrying structure eliminates the troublesome shoes and reduces wear on the circle to an absolute minimum.

Further, the surfaces where the circle bears upon the circle carrying structure are all provided with solid bearing inserts that have anti-friction surfaces, and such inserts are readily replaced when necessary with no wear at all upon the circle structure or the circle carrying structure.

An annular upright wall of the carrying structure provides the inner wall of the closed annular structure in which the internal ring gear is mounted, and an opening in said wall in the plane of the ring gear permits a drive input member which is supported on the circle carrying structure to drivingly engage the ring gear. In that area, the upright wall of the circle carrying structure forms the outer wall of the chamber in which the drive input element is housed, and that chamber also forms a lubricant chamber which carries a supply of lubricant for the input drive member and for the ring gear.

Finally, for added strength, in the area not occupied by said chamber, the annular upright wall is the outside wall of a hollow member which is rectangular in cross section. Radially extending upright plates at the two sides of the circle carrying structure provide partitions between the aforesaid hollow member and the chamber; and those plates extend laterally outward to receive the means by which the circle mounting bar is adjustably suspended from a grader frame.

THE DRAWINGS

FIG. 1 is a side elevational view of a motor grader embodying the invention;

FIG. 2 is a perspective view of a sub-assembly consisting of a circle mounting bar, a circle, and a grader blade, in which the circle mounting bar and circle assembly embody the present invention;

DETAILED DESCRIPTION OF THE INVENTION

Figure 3:
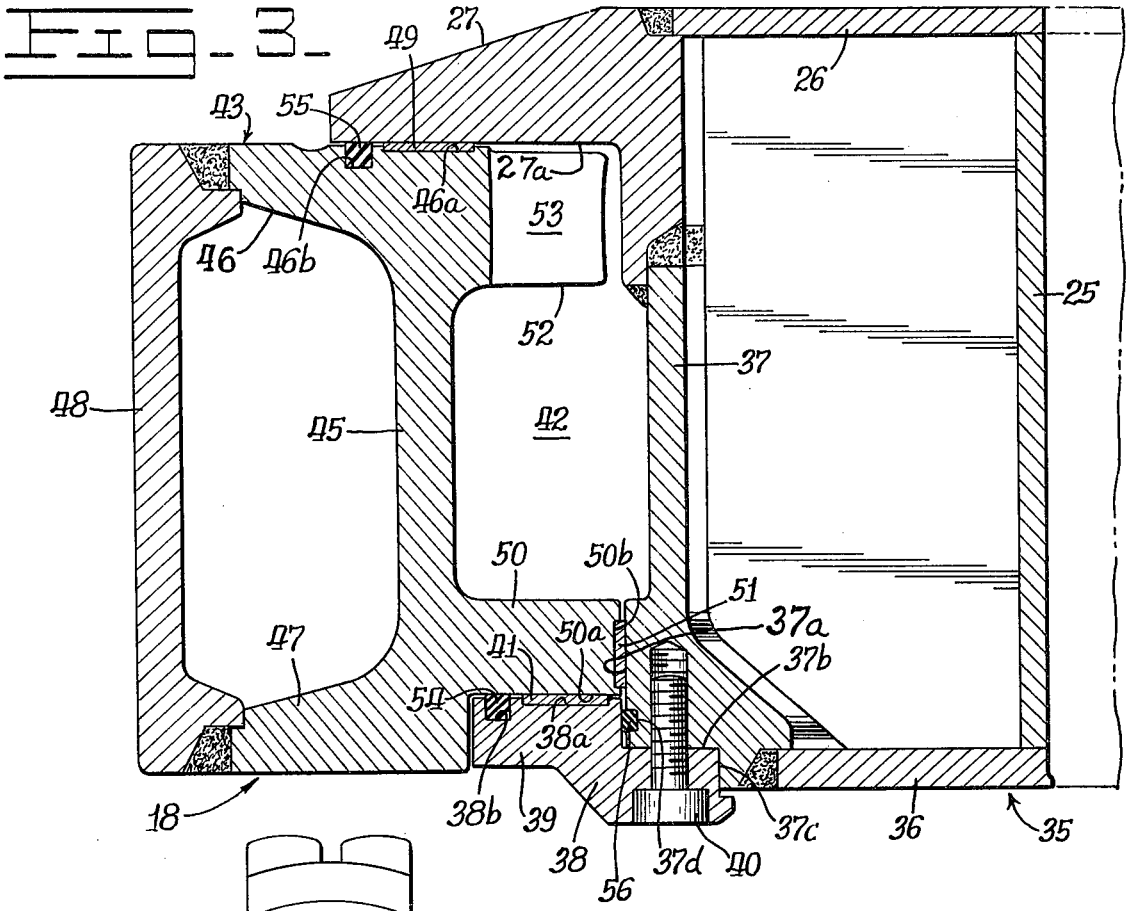
FIG. 3 is a fragmentary sectional view on an enlarged scale taken substantially as indicated along the line 3—3 of FIG. 2.

Referring first to FIG. 1 of the drawings, a motor grader, indicated generally at 10, includes a longitudinal main frame 11 the front end **11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade subassembly, indicated generally at 16, consists generally of a circle mounting bar, indicated generally at 17, which in the illustrated apparatus is a draw bar; a circle structure, indicated generally at 18; and a grader blade and blade mounting, indicated generally at 19**.

The circle draw bar 17 is best seen in FIG. 2 to include a forward beam, indicated generally at 20, and a rearward circle carrying structure, indicated generally at 21, the forward part 22 of which is integral with the rear end of the beam 20. Behind the part 22 of the carrying structure said carrying portion has a section 23 the depth of which is great enough that it forms a housing extending below the circle 18. The housing section 23 receives drive means, indicated generally at 24. The housing section 23 of the circle draw bar merges into a nearly semi-annular upright wall 25 which is part of an internal housing for the circle 18, and integral with the wall 25 is a horizontal top wall 26. An integral flange member 27 overlies the more inward portion of the circle.

The subassembly 16 is mounted under the main frame 11 by means of a front mounting element and rear mounting elements which engage with cooperating elements carried upon the main frame. At the front end 20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston units 31 which are carried upon the main frame 11. Thus, operation of the hydraulic cylinder units 31 swings the circle draw bar 17 about the ball and socket connection including the ball 28, which in this respect provides a horizontal pivot axis. A ball 30*a* on one of the webs 29 provides for a ball and socket connection with a side-shift cylinder (not shown) which shifts the draw bar sideways, with the ball 28 providing a vertical pivot axis.

Referring now to FIG. 3, the semi-annular upright wall 25 and top wall 26 are seen to form two sides of a hollow member, indicated generally at 35, which also has a bottom wall 36 and an upright wall 37 which is annular and forms the front of the housing 23. The flange 27 is welded both to the semi-annular top plate 26 and to the upright wall 37, so as to be structurally integral therewith. The flange 27 has an under side 27*a* which is machined to a fine finish so as to provide a bearing surface.

The upright wall 37 has a machined upright surface 37*a* near its lower end which provides a bearing surface, and it also has a bottom surface 37*b* and a shoulder 37*c* which provide a mounting for an annular bottom flange member 38 which has a radially outwardly extending lip 39 which is in spaced relationship to the integral flange 27 when the flange 38 is secured in place by means of a large number of circumferentially spaced machine screws 40 which screw into threaded bores in the lower end of the annular wall 37. The removal bottom flange 38 extends completely around beneath the top flange 27 and also beneath the bottom of the housing 23 so as to provide support for the entire circumference of the circle member 18. The removable bottom flange 38 has a shallow recess 38*a* in its upper surface to receive bearing plate means 41 which consists of a plurality of arcuate bearing segments which are seated end to end in the recess 38*a* and which have an anti-friction top surface of Teflon or the like, so as to provide a bearing surface for the bottom flange 38. The wall 37, the top flange 27 and the removable bottom flange 38 cooperate to provide an outwardly open annular cavity 42.

The circle structure 18 is seen in FIGS. 2 and 3 to consist generally of a gear supporting body, indicated generally at 43, and blade beams 44 which are structurally integral with the gear carrying portion 43. The gear carrying portion 43 consists of an upright web 45 that has a top web 46 and a bottom web 47 to the outer periphery of which is welded an annular structural member 48 so that the gear carrying portion 43 generally takes the form of an annular box beam, or an annular I-beam with one side closed. This provides an extremely strong circle structure, but one which is of relatively light weight.

The top flange 46 of the structure 43 is provided with a shallow recess 46*a* which receives bearing plates 49 that are the same as the bearing plates 41 heretofore described, so that the upright web 45 has a bearing surface 49 abutting the bearing surface 27*a* of the top flange 27. The bottom flange 47 of the gear carrying ring member 43 includes an inwardly extending annular lip 50 having a finely finished bottom surface 50*a* which serves as a bearing surface that is supported upon the annular bearing means 41; and the inner end of the lip 50 has a shallow recess 50*b* to receive anti-friction bearing means 51 which is in the form of arcuate plates that abut against one another to provide a bearing surface for the lower portion of the web 45 which bears against the upright bearing surface 37*a* of the wall 37. Thus, when the circle 18 is mounted in the outwardly open annular cavity 42, the upright web 45 with its top flange 46 and bottom lip 50 cooperates with the flange 27, the upright wall 37 and the removable flange 38 to define a closed annular chamber. At the upper end of the circle structure web 45 is an internal ring gear 52 having teeth such as those 53 which are seen in FIGS. 3 and 4.

Formed in the upper surface of the removable bottom flange 38, encircling the groove 38*a*, is a slot 38*b* to receive an O-ring seal 54; and surrounding the groove 46*a* in the top flange 46 of the web 45 is a slot 46*b* for an O-ring seal 55 so that the closed annular chamber is sealed against the entry of dust and dirt so as to protect the bearing surfaces 27*a*–49, 41–50*a*, and 37*a*–51, as well as the ring gear teeth 53. In addition, a slot 37*d* in the upright surface 37*a* of the upright wall 37 seats an O-ring 56 which bears against an upright surface of the removable bottom flange 38 so that lubricant which is contained in the housing 23 and the closed chamber does not leak along the edge of the flange.

The upright plates 29 which carry the balls 30 for connection with the hydraulic cylinder and piston units 31 also form partitions between the peripheral end portions of the housing 23 and the interior of the hollow member 35; and between the upright plates 29 the rear of the housing 23 is closed by a wall 57. The bottom plate 36 of the hollow member 35 extends defined beyond the ends of the hollow member defind by the upright plates 29 to form the bottom of the housing 23.

Figure 4:
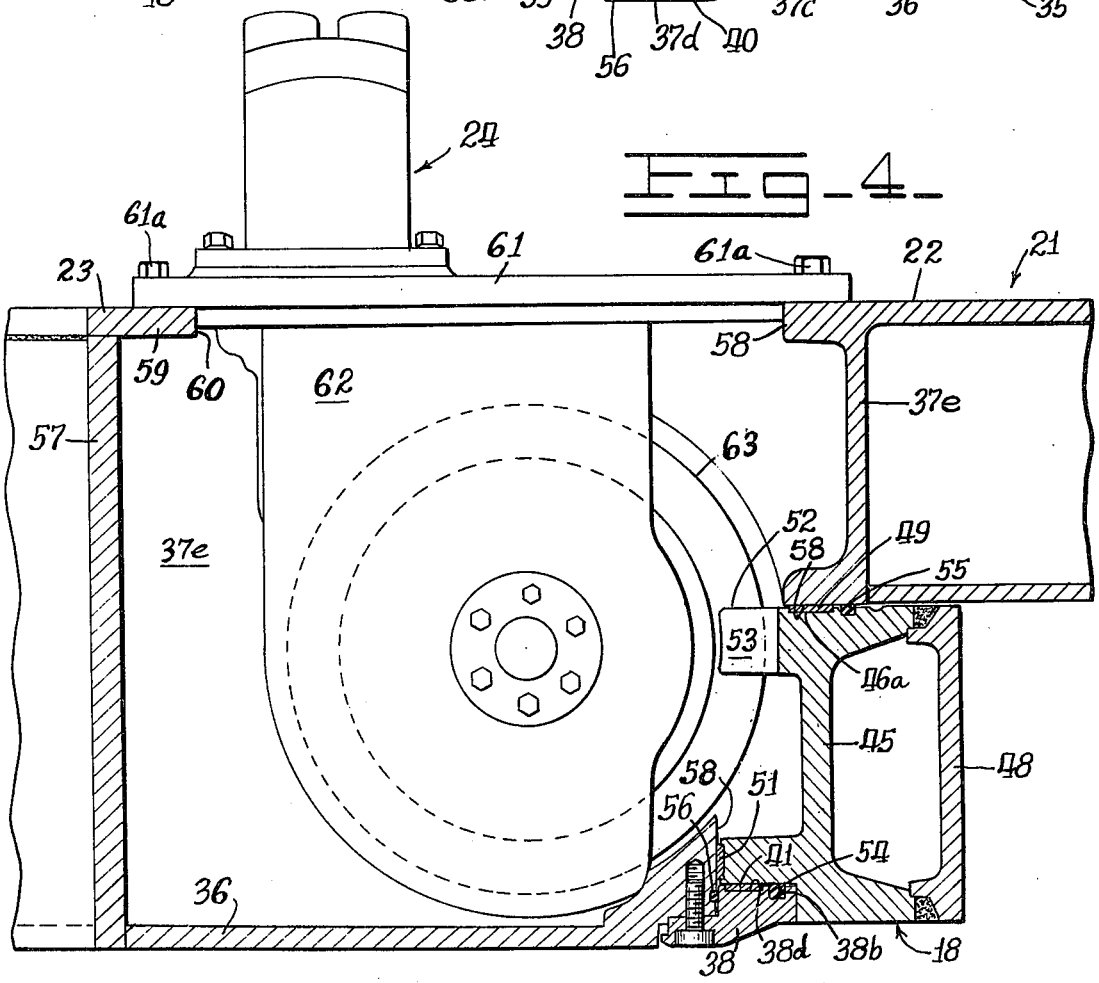
FIG. 4 is a fragmentary sectional view on an enlarged scale taken substantially as indicated along the line 4—4 of FIG. 2.

As seen in FIG. 4, forward of the upright plates 29 the housing is defined by a deep upright wall 37*e* which is effectively a continuation of the wall 37, and the wall 37*e* has a drive opening 58 at the front of the housing 23. The top of the housing consists of a plate 59 having openings such as the opening 60 seen in FIG. 4; and each drive means 24 includes a mounting plate 61 which closes each of the openings 60 and is secured to the top plate 59 by screws 61*a*. A support 62 on the underside of the mounting plate 61 carries drive input means of which an element 63 engages the internal gear means 52 through the drive opening 58.

The foregoing detailed description is given for clearness of understanding only and no unnecessary limitations should be understood therefrom as modifications will be obvious to those skilled in the art.

What is claimed is:

1. A motor grader circle mounting bar and circle assembly comprising, in combination:

a circle mounting bar including a beam with a connecting end, and a circle carrying structure which is structurally integral with the end of said beam opposite said connecting end, said carrying structure comprising an annular, upright wall member provided with a drive opening, and radially outwardly extending top and bottom flange members on said wall member which define therewith an outwardly open annular cavity, said flange members having bearing surfaces facing into said cavity, and one of said flange members being detachably connected to said wall member;

and a circle structure rotatably mounted between said flange members, said circle structure comprising an annular member which has continuous bearing surfaces abutting the bearing surfaces on said flange members and cooperating with the carrying structure to define a closed annular chamber, and internal ring gear means on said annular member in the same transverse plane with the drive opening so said ring gear means may be driven by a drive member supported on the carrying structure;

and a separate sealing means between said annular member and each of said flange members to seal said chamber.

2. The combination of claim 1 in which the top flange member is integral with the upright wall member, said wall member has a mounting surface at its lower end, and the bottom flange member is detachably connected and has a face abutting said mounting surface.

3. The combination of claim 1 in which each two surfaces which are in bearing relationship with one another include one surface consisting of wide, annular bearing plate means fixedly mounted on one of the members.

4. The combination of claim 3 in which each of the annular bearing plate means has its bearing surface facing up.

5. The combination of claim 3 in which each of the bearing plate means is seated in a groove in one of the members.

6. The combination of claim 1 which includes upright, abutting bearing surfaces on said carrying structure and on the annular member below the ring gear.

7. The combination of claim 6 in which one of said upright bearing surfaces consists of wide, arcuate bearing plate means fixedly mounted on one of said carrying structure and said annular member.

8. The combination of claim 7 in which said arcuate bearing plate means is seated in a groove in one of said carrying structure and said annular member.

9. The combination of claim 7 in which the carrying structure upright bearing surface is on the wall member.

10. The combination of claim 1 which includes flange sealing means between the wall member and the detachably connected flange member.

11. The combination of claim 10 in which the detachably connected flange member is secured to the lower end of the wall member, said flange member and said wall member have confronting upright faces, and said flange sealing means is in a slot in one of said faces and bears upon the other of said faces.

12. The combination of claim 11 which includes upright, abutting bearing surfaces on said wall member and on the annular member below the ring gear, said upright bearing surfaces being immediately above said faces.

13. The combination of claim 12 in which one of said upright bearing surfaces consists of wide, arcuate bearing plate means fixedly mounted on one of said wall member and said annular member.

14. The combination of claim 1 in which each of the sealing means is mounted in a slot in one member and bears upon the other member.

15. The combination of claim 14 in which each two surfaces which are in bearing relationship with one another include one suface consisting of wide, annular bearing plate means fixedly mounted on one of the members.

16. The combination of claim 15 in which each of the bearing plate means has its bearing surface facing up and is seated in a groove in the member on which it is fixedly mounted.

17. The combination of claim 16 in which the slots for the sealing means are in the same members as are the grooves for the bearing plate means.

18. The combination of claim 17 in which the top flange member is integral wwith the upright wall member and the bottom flange member is detachably connected to the lower end of the wall member.

19. The combination of claim 1 in which the upright wall member, in the area remote from the beam, is the outside wall of a hollow member which is rectangular in cross section.

20. The combination of claim 19 in which said upright wall member, in the area adjacent the beam, is the outside wall of a housing which is adapted to house a circle drive input member that drivingly engages the ring gear means, and said housing is also adapted to serve as a lubricant reservoir for said drive input member and ring gear means.

21. The combination of claim 20 which includes radially extending upright plates at opposite sides of the circle carrying structure, said plates providing partitions between said housing and said hollow member.

22. The combination of claim 1 in which said upright wall member, in the area adjacent the beam, is the outside wall of a housing which is adapted to house a circle drive input member that drivingly engages the ring gear means, and said housing is also adapted to serve as a lubricant reservoir for said drive input member and ring gear means.

23. The combination of claim 22 which includes radially extending, upright plates at opposite sides of the circle carrying structure, said plates forming parts of the inner wall of said housing and extending laterally outwardly to receive means for adjustably suspending the circle mounting bar from a grade frame.

24. The combination of claim 1 in which the circle structure annular member includes an upright web and radially outwardly extending top and bottom webs, and an annular structural member welded to said top and bottom webs to form a hollow annular structure.

25. The combination of claim 24 in which the upright wall member, in the area remote from the beam, is the outside wall of a hollow member which is rectangular in cross section.

26. The combination of claim 1 in which each sealing means encircles one of the abutting bearing surfaces.

27. In a motor grader which includes a circle carrying structure, a circle supported beneath said carrying structure for rotation about a vertical axis, and an internal ring gear fixed to said circle, an improved circle drive housing comprising, in combination:

means at the forward portion of the circle carrying structure which defines a housing providing a lubricant chamber the lower portion of which is below the plane of the internal ring gear, said housing having a closed bottom wall, a closed rear wall, a top wall with an opening, and a forward wall provided with a drive opening, and the forward part of said circle and said internal ring gear traversing said drive opening;

sealing means in contact with the circle and with the forward wall to seal said drive opening;

and a circle drive means structure including a mounting plate which closes the opening in the housing top wall, a support secured to the underside of said mounting plate, and drive means in said support adapted to be driven from above the mounting plate, said drive means including a drive input member which drivingly engages the internal ring gear adjacent the drive opening.

28. The combination of claim 27 in which the drive opening has a horizontal top surface and a shoulder at the bottom, a removable, annular, circle supporting flange is secured to the circle carrying structure beneath the circle and has a forward portion engaging said shoulder, and the sealing means are between the circle and said horizontal top surface and between the circle and said annular supporting flanges and said shoulder.

* * * * *

UNITED STATES PATENT AND TRADEMARK OFFICE

CERTIFICATE OF CORRECTION

PATENT NO. : 4,015,669
DATED : Apr. 5, 1977
INVENTOR(S) : Carroll Richard Cole

It is certified that error appears in the above-identified patent and that said Letters Patent are hereby corrected as shown below:

Col. 4, line 54, "defined" should be --continuously--;

Col. 4, line 55, "defind" should be --defined--;

Col. 6, line 28 "wwith" should be --with--;

Col. 6, line 59, "grade" should be --grader--.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*